US009658022B1

(12) United States Patent
Farrell et al.

(10) Patent No.: US 9,658,022 B1
(45) Date of Patent: May 23, 2017

(54) FIREARM TRAINING SYSTEM INCLUDING INTEGRATED ELECTRONIC MODULE AND FEATURING ENHANCED OPTICAL DETECTION OF TRIGGER INCURSION

(71) Applicant: SMART FIREARMS TRAINING DEVICES LLC, Tempe, AZ (US)

(72) Inventors: Michael A. Farrell, Phoenix, AZ (US); Calin W. Brabandt, Portland, OR (US)

(73) Assignee: SMART FIREARMS TRAINING DEVICES LLC, Tempe, AZ (US)

( * ) Notice: Subject to any disclaimer, the term of this patent is extended or adjusted under 35 U.S.C. 154(b) by 414 days.

(21) Appl. No.: 14/182,401

(22) Filed: Feb. 18, 2014

Related U.S. Application Data

(60) Provisional application No. 61/765,289, filed on Feb. 15, 2013, provisional application No. 61/823,099, filed on May 14, 2013.

(51) Int. Cl.
*F41A 33/00* (2006.01)

(52) U.S. Cl.
CPC ..... *F41A 33/00* (2013.01)

(58) Field of Classification Search
CPC ..... F41A 17/06
USPC ..... 434/16
See application file for complete search history.

(56) References Cited

U.S. PATENT DOCUMENTS

| | | | | |
|---|---|---|---|---|
| 2,519,672 | A * | 8/1950 | Lawless | C23C 22/50 106/1.23 |
| 5,233,776 | A * | 8/1993 | Hessey | F41A 19/58 42/54 |
| 5,406,731 | A * | 4/1995 | Stevens | F41C 23/10 42/71.02 |
| 5,797,207 | A * | 8/1998 | Marable | B29C 39/10 42/71.02 |
| 7,360,332 | B2 | 4/2008 | Rozovsky | |
| 7,506,468 | B2 | 3/2009 | Farrell et al. | |
| 8,109,024 | B2 * | 2/2012 | Abst | F41A 19/06 124/31 |
| 8,950,100 | B2 * | 2/2015 | Nebeker | F41A 3/64 29/426.1 |
| 2008/0032268 | A1 * | 2/2008 | Farrell | F41A 17/06 434/16 |
| 2008/0060246 | A1 * | 3/2008 | Rozovsky | F41A 17/06 42/70.01 |
| 2012/0141957 | A1 | 6/2012 | Miller | |

* cited by examiner

*Primary Examiner* — Robert J Utama
*Assistant Examiner* — Elroy S Crocker
(74) *Attorney, Agent, or Firm* — Michael J. Andri

(57) ABSTRACT

Optical sensing of trigger region incursion in the context of a firearm training system may be enhanced or otherwise improved through selective use of light absorbent materials within an optical detection range of one or more optical sensors. Surfaces located within a field of view of the optical sensor(s), such as interior facing surfaces of the trigger guard, surfaces of the trigger, and other surfaces located along the optical signal path may include light absorbent materials, such as dark surface colors, matte finishes, surface textures, and/or thin-film coatings that filter and/or absorb light of a particular wavelength or wavelength range.

13 Claims, 11 Drawing Sheets

FIREARM TRAINING SYSTEM INCLUDING INTEGRATED ELECTRONIC MODULE AND FEATURING ENHANCED OPTICAL DETECTION OF TRIGGER INCURSION

CROSS-REFERENCE TO RELATED APPLICATION

The present application claims priority to U.S. Patent Application Ser. No. 61/765,289, titled FIREARM TRAINING SYSTEM FEATURING ENHANCED OPTICAL DETECTION OF TRIGGER INCURSION, filed Feb. 15, 2013, the content of which is incorporated herein by reference in its entirety for all purposes. The present application also claims priority to U.S. Patent Application Ser. No. 61/823,099, titled FIREARM TRAINING SYSTEM INCLUDING INTEGRATED ELECTRONIC MODULE, filed May 14, 2013, the content of which is also incorporated herein by reference in its entirety for all purposes.

BACKGROUND

Firearm training is an effective tool for reducing accidental or unintended discharge of a firearm. U.S. Pat. No. 7,506,468 discloses a method and apparatus for monitoring handling of a firearm in which a warning, notification, status or control signal is generated when a user's finger position is proximate a trigger. This approach relies, at least in part, on an optical sensor that monitors a trigger region of an actual firearm or a simulated mock firearm.

SUMMARY

A firearm training system is disclosed that utilizes optical sensing for the detection of trigger region incursion. In one example, a firearm training system includes a device body that simulates a firearm that includes an integrated trigger guard. In another example, a firearm training system includes a device body that simulates a first portion of a firearm and a separate trigger guard that simulates a second portion of the firearm. In each of these examples, the trigger guard has one or more interior facing surfaces that at least partially define a trigger region that contains a trigger.

The firearm training system further includes an electronic module including one or more optical sensors. In one example, the optical sensors observe the trigger region through an opening formed in an opposing interior facing surface of the device body or trigger guard that opposes the one or more interior facing surfaces of the trigger guard. The electronic module may be tuned to detect incursion of an object within the trigger region based on a defined wavelength or wavelength range of light captured via the optical sensors. The electronic module detects trigger region incursion and/or trigger actuation, and provides an audible and/or visual output in the form of feedback to the user operator.

A trigger located within the trigger region, one or more interior facing surfaces of the trigger guard, as well as other surfaces of the system that are located within a field of view of the optical sensors have a light absorbent property that filters reflected light within the defined wavelength or wavelength range to a greater extent than other portions of the device body located outside the field of view of the optical sensors. A greater light absorbent property may be provided through the use of surfaces having low reflectivity, including darkly colored surfaces, surface films or treatments that filter light of a defined wavelength or wavelength range, textured surfaces, and/or matte-finish surfaces. In some implementations, such as in the case of a simulated firearm, portions of the device body located outside the field of view of the optical sensors may include brightly colored surfaces to visually distinguish simulated firearm of the firearm training system from a fully functioning firearm.

This summary includes only some of the concepts disclosed in greater detail by the following detailed description and associated drawings. As such, claimed subject matter is not limited to the contents of this summary.

DETAILED DESCRIPTION

Figure 1:
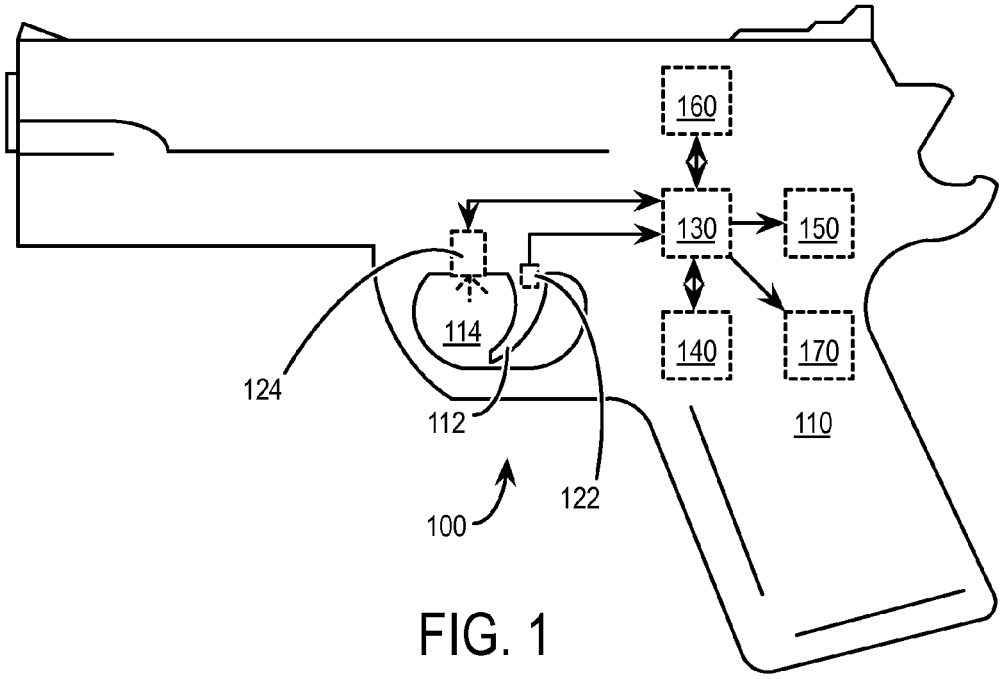
FIG. 1 is a schematic diagram depicting a generalized view of an example firearm training system.

A firearm training system is disclosed that utilizes optical sensing for the detection of trigger region incursion. Communicating instances of trigger region incursion to a user operator during training exercises provides an effective tool for reducing accidental or unintended discharge of a firearm. The inventors of the present disclosure have identified a number of issues associated with prior approaches for detecting trigger region incursion, and have also recognized several considerations for firearm training systems that provides effective optical detection of trigger region incursion.

As one example, the inventors have recognized that some firearm training devices utilize a simulated mock firearm having brightly colored surfaces to distinguish the training device from a fully functional firearm. Non-limiting examples of such bright colors include orange, yellow, red, green, blue, etc. Such brightly colored surfaces and other highly reflective surfaces have low light absorbent properties. When located within a field of view of an optical sensor, such brightly colored and/or highly reflective surfaces may reduce the effectiveness of many optical detection techniques, and may result in false detections or low detection sensitivity. This reduction in effectiveness may be due in part to the reduction in background contrast and increased background noise in relation to a foreign object (e.g., a finger) passing into the trigger region and within a field of view of the optical sensor.

The inventors have recognized that background noise in the form of reflected light may be reduced by selective use or inclusion of materials having low light reflectivity and high light absorbent properties for portions of the firearm training system located within a field of view of optical sensors used to detect trigger region incursion. Depending on sensor orientation, these portions may include interior facing surfaces of the trigger guard, the trigger, surfaces defining an opening through which the optical sensor observes the trigger region, and/or other surfaces located along an optical pathway of the optical sensor. By reducing background noise caused by light reflected from portions of the firearm training system, detection sensitivity of the system may be improved, thresholds for detecting trigger region incursion through optical sensing may be reduced, false detection of trigger region incursion may be reduced, and sensor cost and/or data processing overhead may be reduced.

As an illustrative example, some or all of the above described issues in prior approaches and the advantages of the inventors' approach may be more pronounced when a holster is used in combination with the firearm training system. Holsters (including even darkly colored or black holsters) have the potential to create significant infrared reflections (or reflections of other wavelengths of light) when the firearm training system is housed within the holster that can cause false detection of trigger region incursion by a foreign object. The inventors have recognized that the trigger guard, the trigger, and/or other surfaces of the system located along an optical pathway of the optical sensor may play a role in these reflections involving the holster. When operating outside of a holster, the trigger guard, trigger, and/or other reflective surfaces within the field of view of the optical sensors could be "zeroed-out" or otherwise accounted for within the system's software or firmware to reduce false detections by tuning detection thresholds in relation to the background noise generated by the reflective surfaces. However, this technique may be insufficient to realize acceptable noise margins for holster training applications in which the firearm training system is removed from and inserted into the holster, or across a range of varying ambient light conditions.

Accordingly, optical sensing for the detection of trigger region incursion may be enhanced or otherwise improved through selective use, inclusion, and/or application of materials having a greater light absorbent property/lower light reflectivity for surfaces of the firearm training system that are located within an optical path, detection range, or field of view of the optical sensors. As one example, a firearm training system includes a trigger guard having one or more interior facing surfaces that at least partially define a trigger region within which a trigger is located. An electronic module of the firearm training system includes one or more optical sensors observing the trigger region through an opening formed in an opposing interior facing surface of the trigger guard region that opposes the one or more interior facing surfaces of the trigger guard. The electronic module may be tuned to detect incursion of an object within the trigger region based on a defined wavelength or wavelength range of light captured by the one or more optical sensors. The optical sensors may have a field of view that includes at least a portion of the one or more interior facing surfaces of the trigger guard, one or more surfaces of the trigger, and/or interior facing surfaces of the opening within the ceiling of the trigger region. These surfaces located within the field of view of the optical sensor(s) may have a light absorbent property that filters reflected light within the defined wavelength or wavelength range to a greater extent than one or more other surfaces of the device body located outside the field of view of the one or more optical sensors.

A light absorbent, low reflectivity, or anti-reflective property, as described herein, may refer to a property of a material that absorbs, filters, or otherwise reduces reflection of light (e.g., visible, infrared, etc.) or other forms of electromagnetic radiation at a defined wavelength (or frequency) or within a wavelength range (or frequency range) used for the optical detection of trigger region incursion. Such materials may provide increased light absorption or reduced light reflectivity relative to other portions of the firearm training system through the inclusion of: darkly colored surfaces, surface films or treatments that filter light of a defined wavelength or wavelength range, textured surfaces, and/or matte-finish surfaces.

While all or most materials may be characterized as having at least some level of light absorbing capability or light reflectivity, the materials described herein typically have a light absorbent or anti-reflective property that is substantially greater than other materials that form system components located outside of the optical detection region. Such materials may also have a light absorbent or anti-reflective property that is substantially greater than the light absorbent or anti-reflective property of a foreign object, such as a human finger to be detected within the optical detection region. Materials having a greater light absorbent/anti-reflective property forming a background or backdrop over which a human finger may be detected can provide enhanced detection capability with regards to trigger region incursion.

FIG. 1 is a schematic diagram depicting a generalized view of an example firearm training system 100. Firearm training system 100 includes a device body 110 that simulates a firearm, includes a fully functional firearm, or includes a non-functional or disabled firearm. Device body 110 of FIG. 1 takes the form of a handgun. In other examples, the device body may take the form of a rifle or other suitable firearm form factor.

Device body 110 may be formed from any suitable material. In one example, device body is formed from a polymer, such as an injection molded or printed plastic. However, device body may be formed from other suitable materials or combination of materials, including metal, polymer, wood, ceramic, etc.

Firearm training system 100 further includes a trigger 112 and a trigger sensor subsystem 122 that detects actuation of trigger 112. Trigger sensor subsystem 122 may include a Hall effect sensor, for example, that detects actuation of a trigger rotatably mounted to the firearm training system. Trigger 112 is located within or near a trigger region 114 formed within or by device body 110 and/or by a trigger guard. Depending on implementation, the device body may include an integrated trigger guard or may be combined with a separate trigger guard portion that at least partially defines a trigger region.

Firearm training system 110 further includes a trigger region incursion sensor subsystem 124 that detects incursion of a foreign object (e.g., a human finger) within or near trigger region 124. Incursion sensor subsystem 124 may include one or more light sources that output light at a defined wavelength or wavelength range, and one or more optical sensors that capture light at a defined wavelength or wavelength range. As one example, incursion sensor subsystem 124 may include an infrared light source (e.g., IR emitter) and an optical sensor that detects infrared light. As another example, incursion sensor subsystem 124 may include a visible light source and an optical sensor that detect visible light or a portion of the visible spectrum. It will also be understood that incursion sensor subsystem 124 may be located at other suitable locations, positions, or orientations in comparison to FIG. 1 for detecting trigger region incursion.

In at least some implementations, sensor subsystems 122 and 124 output signals indicative of detected trigger pull and detected incursion of an object into the trigger region, respectively. Firearm training system 100 further includes a control subsystem 130 that receives signals output by one or more of sensors 122 and 124, processes those signals, and provides an output responsive to those signals. Sensor subsystems in combination with control system 130 may form an electronic module that provides detection and reporting of trigger region incursion and trigger activation. Control subsystem 130 and/or other electronic components of firearm training system 100 may receive electrical energy from an energy storage device 140 located on-board device body 110. Control subsystem 130 may provide control signals and/or electrical energy to incursion sensor subsystem 124, such as to control and/or power an infrared light source or other suitable light source, among other energy consuming components.

In at least some implementations, the output of control subsystem 130 may include output signals directed to an audio speaker 150 or other suitable audio output device residing on-board device body 110. As one example, responsive to a trigger pull detected by control subsystem 130 via trigger sensor 122, control subsystem 130 may generate an audio output via audio speaker 150. As another example, responsive to a foreign object entering within or near trigger region 114 as detected by control system 130 via trigger region incursion sensor 124, control system 130 may generate an audio output via audio speaker 150. The audio output generated in response to a trigger pull may differ from or may be the same as the audio output generated in response to incursion of an object into or near trigger region 114, depending on implementation.

In at least some implementations, the output of control system 130 may include output signals directed at one or more light emitting elements 160 residing on-board device body 110. As one example, responsive to a trigger pull detected by control subsystem 130 via trigger sensor 122, control subsystem 130 may generate a visible light output via one or more light emitting elements 160. As another example, responsive to an object entering within or near trigger region 114 as detected by control system 130 via trigger region incursion sensor 124, control system 130 may generate a visible light output via one or more light emitting elements 160. The visible light output generated in response to a trigger pull may differ from or may be the same as the visible light output (e.g., color, flashing frequency, duration, etc.) generated in response to incursion of an object into or near trigger region 114, depending on implementation, and may utilize the same or different light emitting elements.

In at least some implementations, the output of control subsystem 130 may include output signals directed to a data storage device 170 residing on-board device body 110. As one example, data storage device 170 may include a memory device (e.g., flash memory or other suitable form of data storage). Data storage device 170 may receive and store instances of trigger pull and trigger region incursion in association with a time stamp in a manner that enables these events to be distinguished from each other. Data stored at data storage device 170 may be off-loaded or downloaded to a computing device over a wired or wireless communications link for analysis and presentation using any suitable interface and/or communications protocol. Control subsystem 130 may take the form of a computing device or logic device that executes instructions in the form of software and/or firmware.

Figure 2:
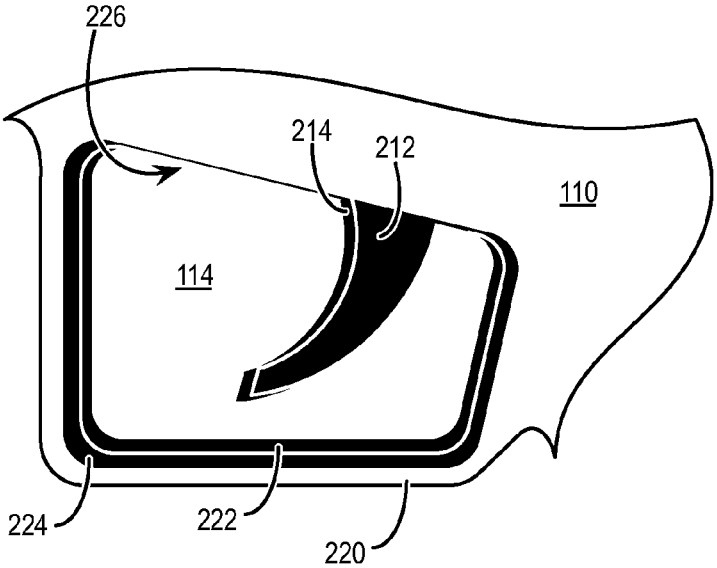
FIG. 2 depicts a detailed view of an example trigger region of a firearm training system.

FIG. 2 depicts a detailed view of an example trigger region of a firearm training system according to the present disclosure. The example trigger region depicted in FIG. 2 may refer to a detailed view of previously described trigger region 114, device body 110, and trigger 112 of FIG. 1. However, the teachings of FIG. 2 may be applicable to other firearm training systems that have different physical forms. In FIG. 2, the trigger and the components of device body 110 or a trigger guard (defined by surfaces 220, 222, 224, etc.) defining and/or surrounding trigger region 114 include a material having a light absorbent property (indicated schematically in FIG. 2 by dark colored regions) that absorbs, filters, and/or reduces reflection of light in a wavelength or frequency range detectable by sensor subsystem 124. While surface 220 is depicted as not including a material having a greater light absorbent property, it will be appreciated that surface 220 of the trigger guard or the entire trigger guard may include material having a greater light absorbent property than other surfaces of the device body that are outside of a field of view of the optical sensors.

As previously discussed, a device body of a firearm training system or portions thereof located outside of the optical detection region may have a bright or visibly recognizable color (e.g., orange, red, yellow, blue or bright blue, green, gold, etc.) that is distinct from the traditional black, stainless steel, or bluing color of fully functional firearms. The bright or visibly recognizable appearance of such training devices may be preferred over the appearance of a traditional fully functional firearm for a variety of reasons, including providing a visual indicator that clearly distinguishes the training device from a fully functional firearm. These bright or visibly recognizable materials may have relatively poor light absorbent properties and/or high light reflectivity. Hence, if used within the optical detection region, these bright or visibly recognizable colors may result in increased false detection of trigger region incursion, increased background noise, reduced sensitivity thresholds for incursion, require increased cost/complexity/quality of sensor components or data processing overhead, and/or increased energy consumption of sensor components.

Figure 6:
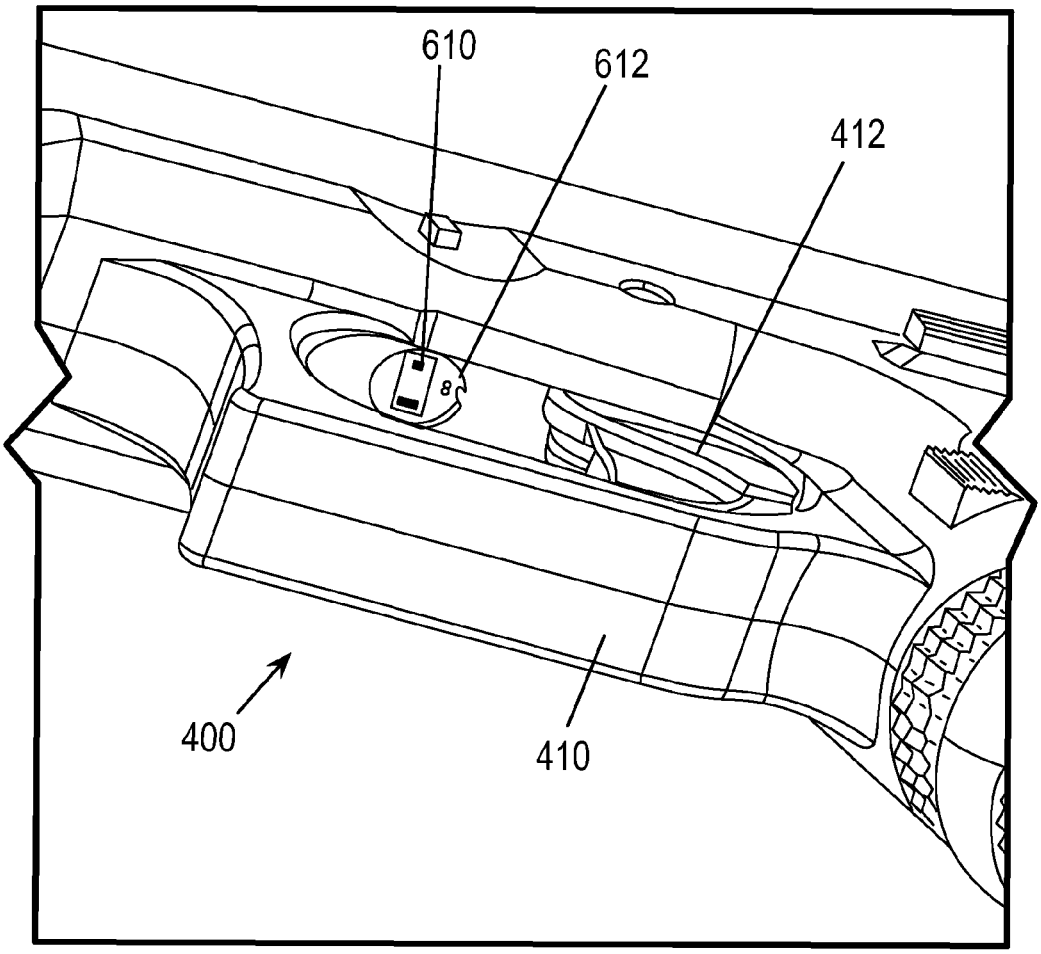

As one example, one or more of surfaces 222, 224, 212, 214, and 226 (which may include interior facing surfaces of an opening in a ceiling of the trigger region through which the optical sensor(s) observe the trigger region depicted in further detail in FIG. 6) have a darker surface color or lower reflectivity than one or more other surfaces of the device body located outside of the field of view of the optical sensors. As another example, one or more of surfaces 222, 224, 212, 214, and 226 include textured surfaces formed in the material (e.g., molded or printed as part of the material) of the trigger guard, trigger, or device body that reduce light reflection or increase light absorption within a defined wavelength or wavelength range. As yet another example, one or more of surfaces 222, 224, 212, 214, and 226 include a thin-film coating that filters light within a defined wavelength or wavelength range. As yet another example, one or more of surfaces 222, 224, 212, 214, and 226 include a matte finish that reduces light reflection or light absorption within a defined wavelength or wavelength range. Some or all of these examples may be used in combination with each other to reduce light reflectivity of surfaces located within the field of view of the optical sensors that observe the trigger region.

A surface treatment that reduces reflectivity may take the form of a paint, film, or other coating applied to a material that forms the device body, trigger guard, or trigger. The surface treatment may have a substantially greater light absorbent property than other body portions 110, such as the handle of the firearm, the barrel, the slide, etc. In some implementations, all surfaces or substantially all surfaces of the device body may include the surface treatment. A sub-surface layer having a light absorbent property may be alternatively or additionally used. For example, a sub-surface layer within the device body, trigger guard, and/or trigger may underlie the outer surface(s) (e.g., an optically transparent or translucent surface for the detectable forms of electromagnetic radiation of the sensor or a film that filters such detectable forms) of the device body. Alternatively or additionally, portions of the device body (e.g., trigger guard and/or device body portions defining the trigger region) or the entire device body and/or the trigger may be formed from a material having a light absorbent property. The light absorbent property of these body portions, trigger, or layers thereof may be substantially greater than other portions of the firearm training system that are outside of the detection region of sensor subsystem 124, or substantially greater than the light absorbent property of a human finger.

As a non-limiting example, the trigger guard and/or the trigger of a firearm training system located within a detection region of a trigger region incursion sensor may have outer surfaces of a darker hue or color (e.g., black, gray, darker colors, etc.) and/or matte finish as compared to other body portions that reside outside of the detection region that may have a brighter color and/or gloss reflective surface.

Figure 3:
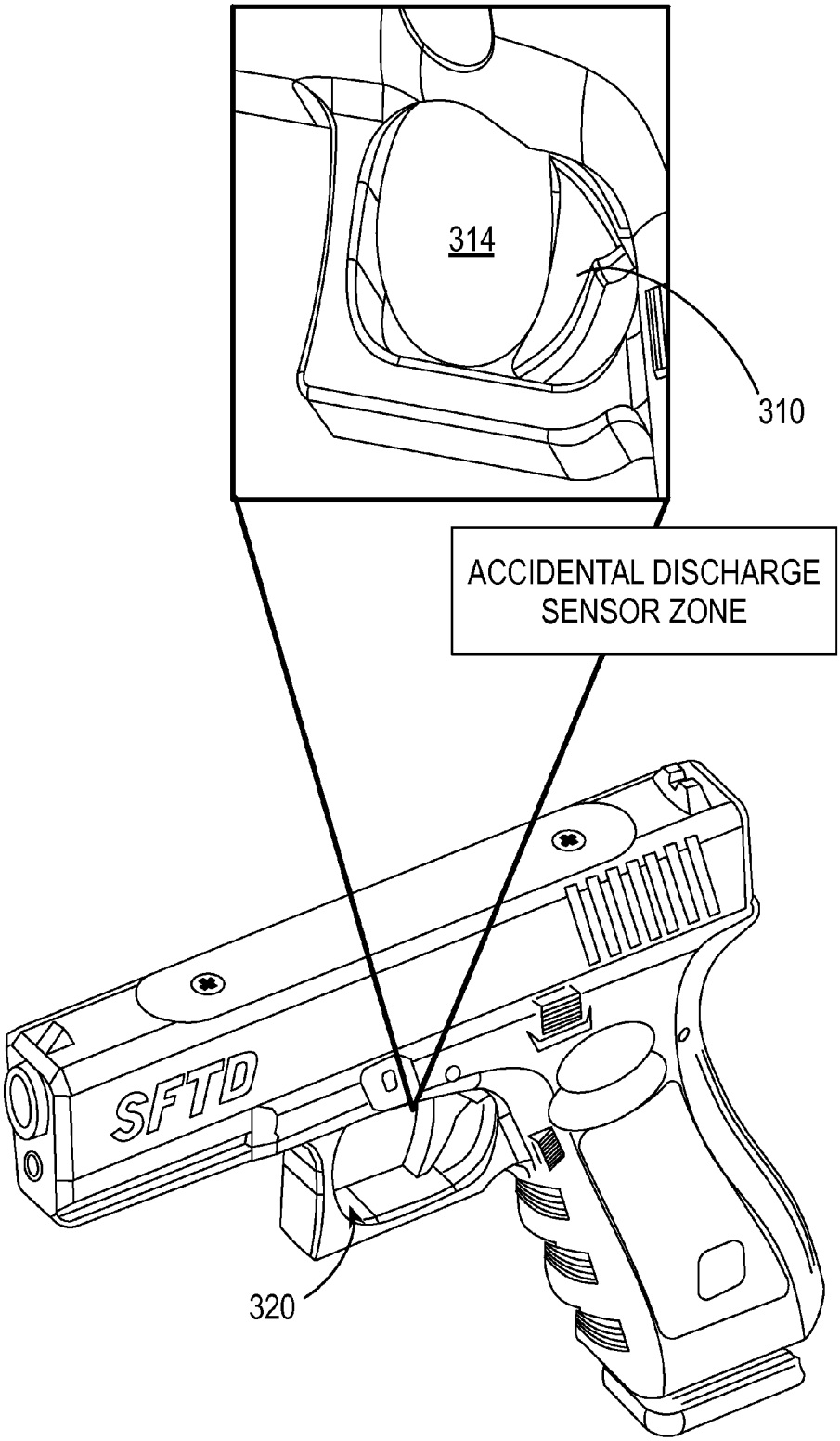
FIG. 3 depicts another detailed view of an example trigger region of a firearm training system.

FIG. 3 depicts another detailed view of an example trigger region of a firearm training system. FIG. 3 depicts additional non-limiting examples of light absorbent materials at surfaces 310 of a trigger and 320 of an inner facing surface of a trigger guard that may be used within the optical detection region of a trigger region incursion sensor. FIG. 3 further depicts a foreign object 314, such as a human finger located within a trigger region proximate a trigger.

Figure 4:
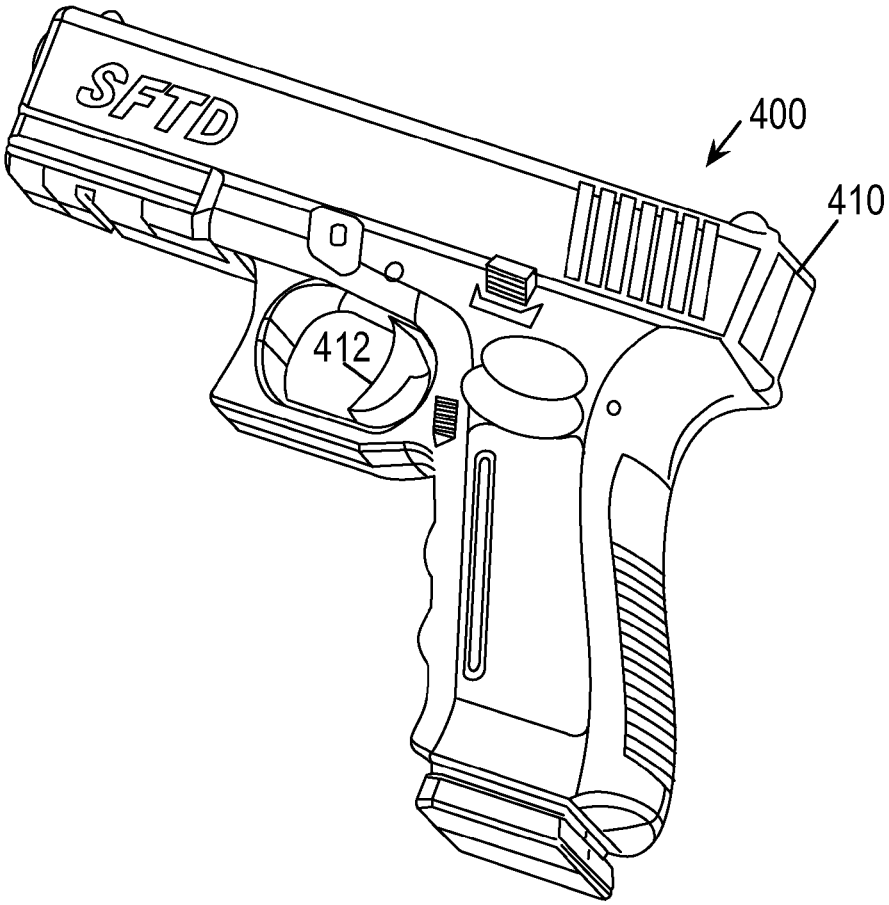
FIGS. 4-14 depict an embodiment of a firearm training system having a trigger guard integrated into or forming part of a device body.

FIGS. 4-14 depict an embodiment of a firearm training system 400 having a trigger guard integrated into or forming part of a device body. Firearm training system 400 provides a non-limiting example of previously described firearm training system 100 of FIG. 1. FIG. 4 depicts a first view of firearm training system 400, including device body 410 and a trigger assembly 412. Device body 410 depicted herein takes the form of a handgun. In other examples, the device body may take the form of a rifle or other suitable firearm form factor. Body 410 may be formed from any suitable material. In one example, the device body may be formed from a polymer, such as an injection molded or printed plastic. However, the device body may be formed from other suitable materials or combination of materials, including metal, polymer, wood, ceramic, etc.

In one example, an integrated electronic module of firearm training system 400 supports optical sensing of the trigger region to detect trigger region incursion. The integrated electronic module of firearm training system 400 may additionally detect actuation of a trigger of trigger assembly 412 that is located within or near a trigger region formed within or by body 410. The trigger region may be at least partially defined by a trigger guard in some examples. Firearm training system 400 further includes a trigger region incursion sensor subsystem depicted in FIG. 6 that detects incursion of a foreign object (e.g., a finger) within or near the trigger region.

Figure 5:
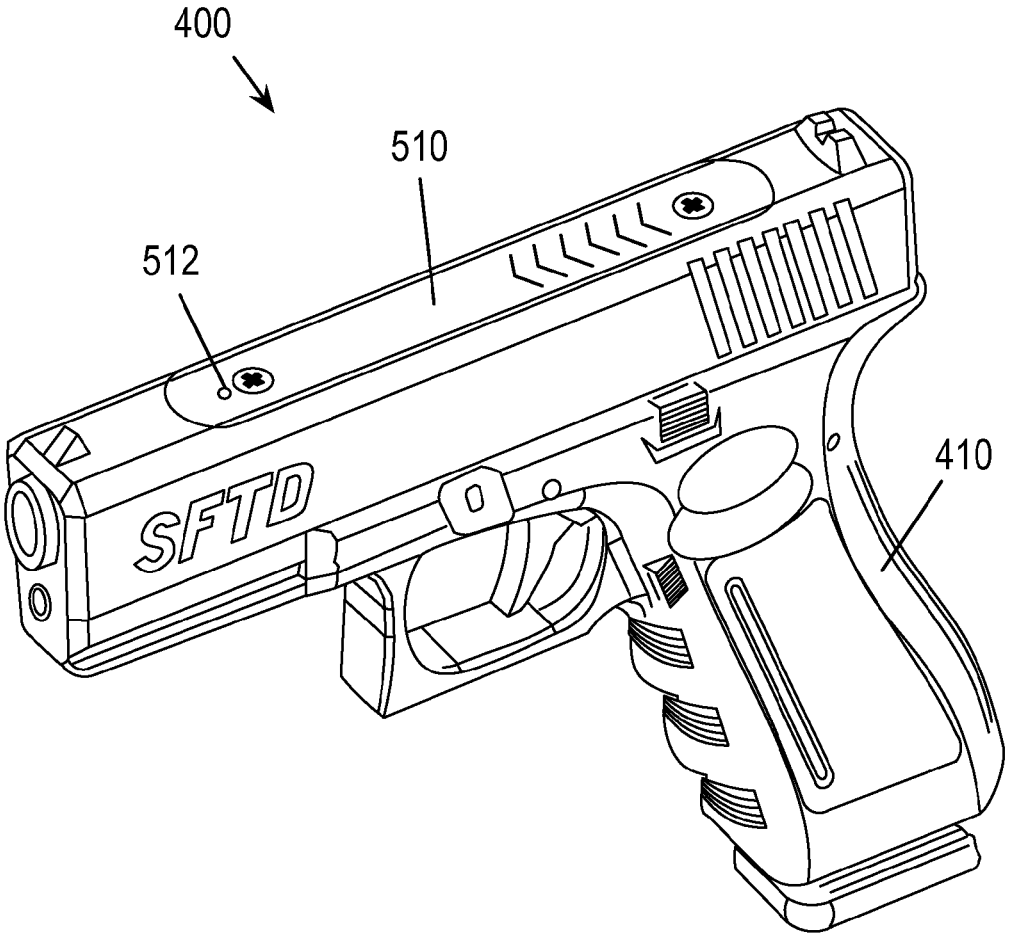

FIG. 5 depicts an access panel or cover 510 that conceals the integrated electronic module contained within or at least partially within device body 410. In at least some examples, cover 510 or other portions of device body 410 may include an interface element 512. In one example, interface element 512 may take the form of a depressible button enabling a user operator to effect or control one or more functions of the integrated electronic module. Additionally or alternatively, interface element 512 may take the form of an aperture or lens through which an optical sensing element and/or light emitting element located within body 410 may receive and/or transmit light or other suitable form of electromagnetic radiation. In one example, background light conditions may be detected by the integrated electronic module via interface element 512. In another example, information may be communicated between firearm training system 400 and a remote computing device by light transmission and/or reception via interface element 512.

FIG. 6 depicts a detailed view of the trigger guard region of firearm training system 400 to reveal an opening or aperture 612 through which one or more optical sensors of a sensor subsystem 610 may receive and/or emit electromagnetic radiation, such as visible light, infrared, or other suitable wavelength or wavelength range. In this particular example, opening or aperture 612 and sensor subsystem 610 are located at or within the ceiling of the trigger guard region and in front of the trigger assembly 412. One or more optical sensors of sensor subsystem 610 observe the trigger region through opening 610. The ceiling of the trigger guard may include additional openings, such as behind the trigger to provide a signal path between the trigger and a Hall effect sensor or other suitable sensor for detecting trigger actuation. The light source or electromagnetic radiation source generated by sensor subsystem 610 may point downward from the ceiling of the trigger guard region at an orientation that is orthogonal to the ceiling surface. However, other suitable orientations may be used. In one example, sensor subsystem 610 may include an infrared light source (e.g., IR emitter) and an optical sensor that detects infrared light. In another example, sensor subsystem 610 may include at least one emitter and one, two, or more optical sensors that detect light of a defined wavelength or wavelength range. Multiple emitters and optical sensors may be used to provide increased detection range and/or a geometrically suitable detection range within or surrounding the trigger guard region.

A non-limiting example of sensor subsystem 610 includes the optical sensor product manufactured and distributed by Vishay Semiconductors™ designated as model VCNL4010, which includes a fully integrated IR proximity and ambient light sensor. Firearm training system 400 may further include one or more optical filters located between sensor subsystem 610 and the trigger region, such as within or covering opening or aperture 612 to filter or block visible light (or other suitable frequency component) while passing IR light (or other suitable frequency component). It will be understood that other forms of optical sensors and/or light sources/emitters may be used, including sensors and/or light sources/emitters that function in the visible light frequency range (e.g., with the omission of the visible light filter) and/or other suitable frequency ranges. It will also be understood that sensor subsystem 610 may be located at other suitable locations, positions, or orientations for detecting trigger region incursion.

Within FIG. 6, opening 612 is depicted as having a circular shape. However, opening 612 may have any suitable shape including oval, square, etc. In some examples, opening 612 may take the form of a long tube formed within the ceiling of the trigger region. As described in FIG. 2 with reference to 226, interior facing surfaces of an opening such as example opening 612 may have or include a light absorbent or anti-reflective property.

Figure 7:
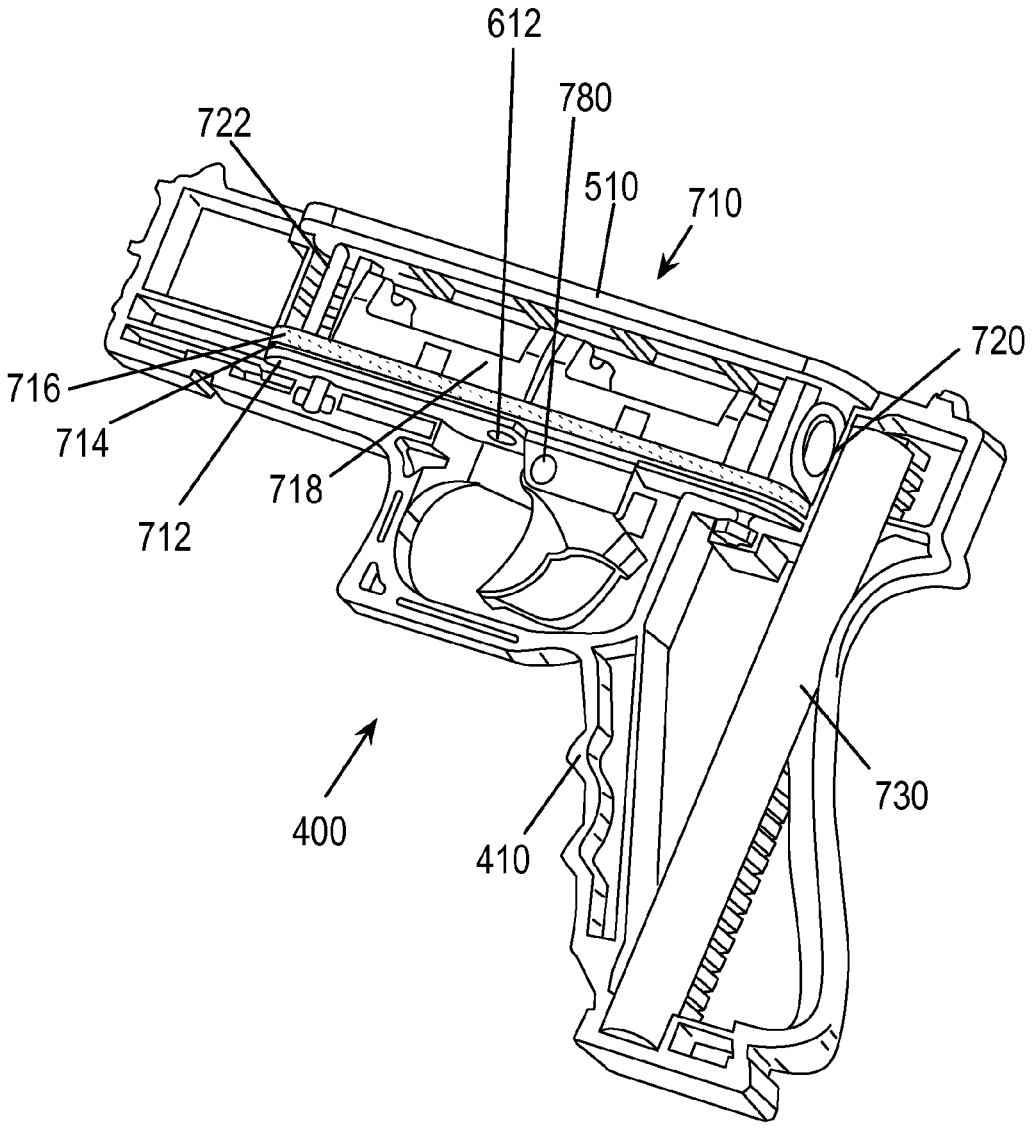

FIG. 7 depicts a view of firearm training system 400 with a portion of the device body removed to reveal various internal components. In the embodiment depicted in FIG. 7, the device body is formed from two device body halves that are joined at a plane that passes through a centerline of the simulated firearm. A non-limiting example of the integrated electronic module is depicted at 710. Integrated electronic module 710 includes a circuit board 716 that contains, supports, and interconnects various electronic components. Integrated electronic module 710 includes mounting element 712 upon which trigger assembly 412 and circuit board 716 are mounted. Integrated electronic module 710 includes a gasket 714 located between circuit board 716 and mounting element 712. In some examples, gasket 714 may be omitted. Mounting element 712 may include a mounting plate or bracket, and may be formed from sheet metal or other suitable material. Mounting element 712 may provide a sound mechanical mount for the circuit board and may also include a hinge arm on which the trigger pivots.

Integrated electronic module 710 includes battery compartments 718 mounted on and operatively coupled with circuit board 716. Integrated electronic module 710 includes an audio speaker assembly 720 containing an audio speaker mounted on and operatively coupled circuit board 716. Integrated electronic module 710 includes transmitting element 722 mounted on and operatively coupled with circuit board 716. In one example, transmitting element 722 may optically communicate with interface element 512 and other electronic elements mounted on circuit board 716. Additionally or alternatively, transmitting element 722 may transmit a force caused by depression of interface element 512 between interface element 512 and other electronic elements mounted on and operatively coupled with circuit board 716. FIG. 7 further depicts how body 410 may define a region that accommodates a mass element 730 that serves to increase the overall mass of the firearm training system to more closely resemble the mass of an actual or fully functional firearm. In one example, mass element 730 takes the form of a steel rod or bar, however, other suitable materials and material form factors may be used.

FIG. 7 further depicts opening or aperture 612 located within a ceiling of the trigger region defined by the device body. Also depicted within FIG. 7 is a rotatable coupling 780 upon which the trigger is mounted to the trigger assembly and/or electronic module, enabling actuation of the trigger.

Figure 8:
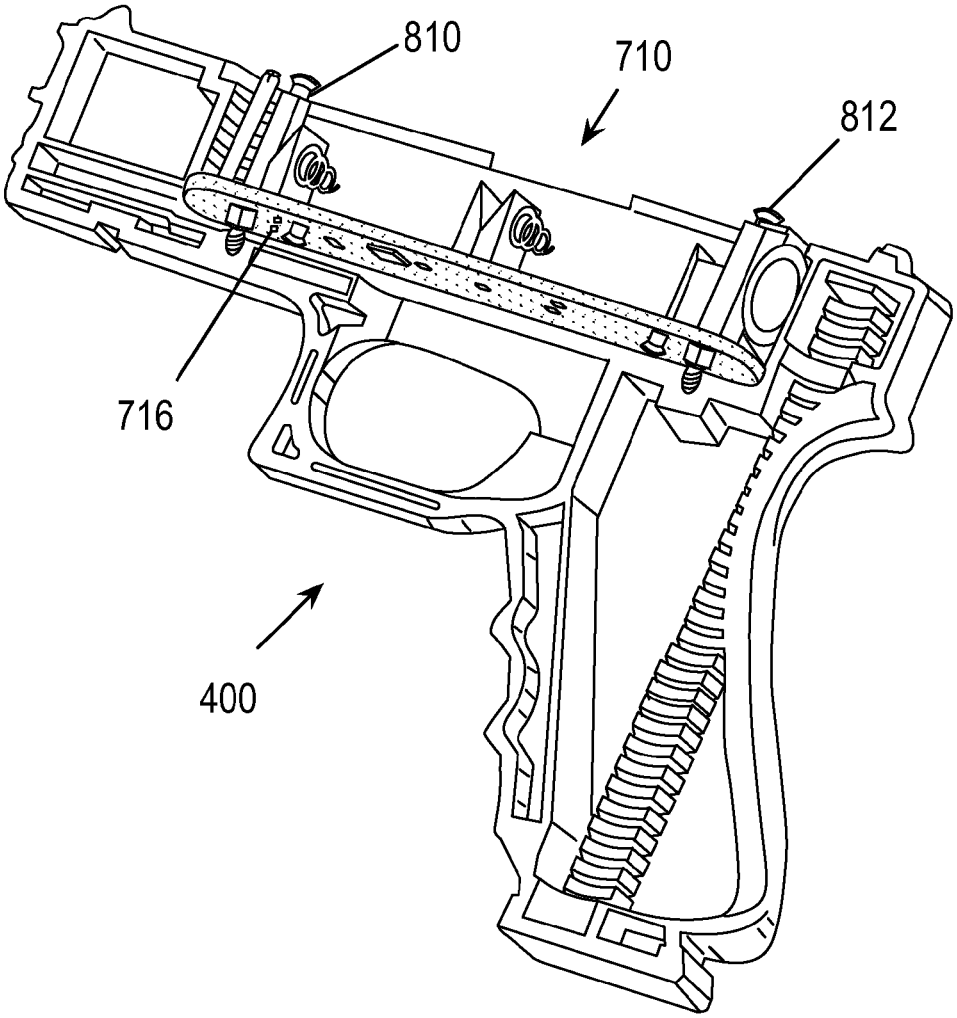

FIG. 8 depicts integrated electronic module 710 with battery compartments 718, gasket 714, mounting element 712, cover 510, trigger assembly 412, and mass element 730 removed to reveal further detail. FIG. 8 further depicts posts 810 and 812 used to secure integrated electronic module 710 and/or cover 510 to body 410. Posts 810 and 812 may take the form of any suitable fastener, such as screws or bolts, for example. In the non-limiting example of FIG. 8, the posts are secured on a distal end to the device body to secure the electronic module, cover, and trigger assembly.

Figure 9:
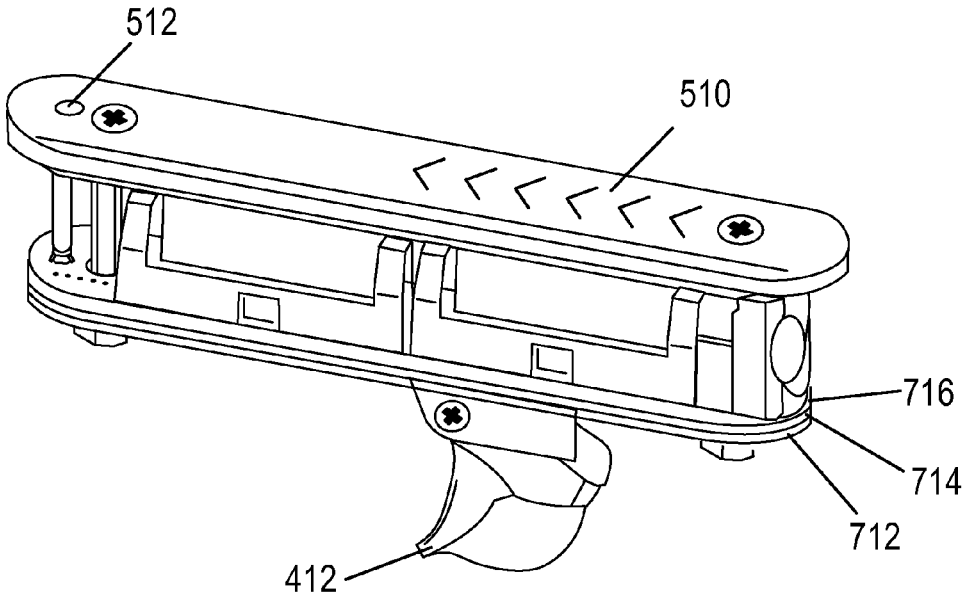
Figure 10:
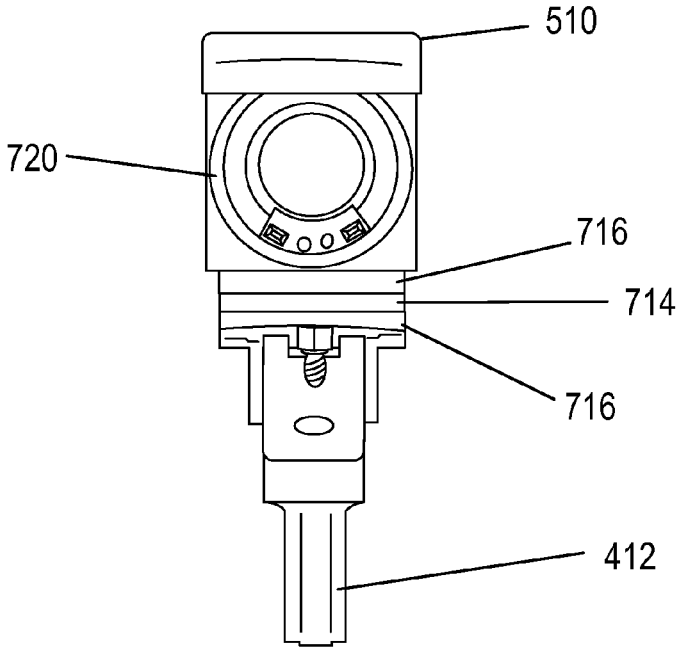
Figure 11:
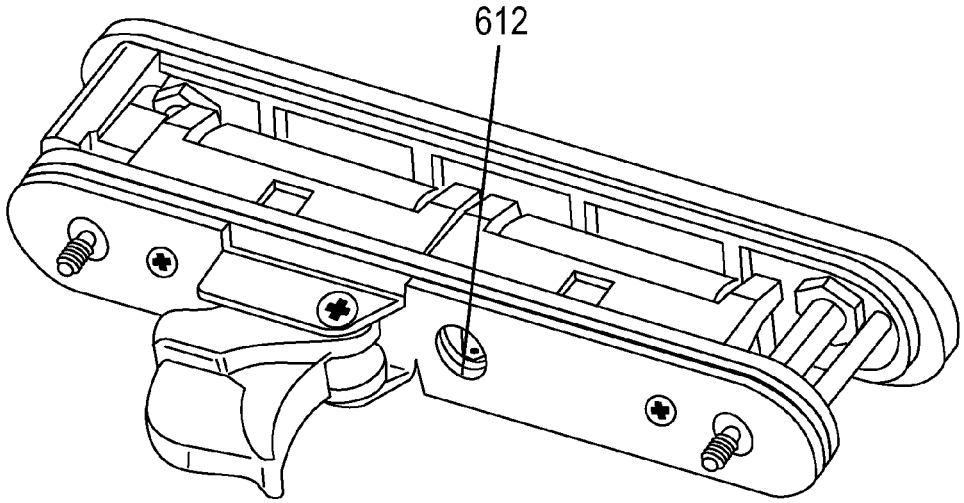
Figure 12:
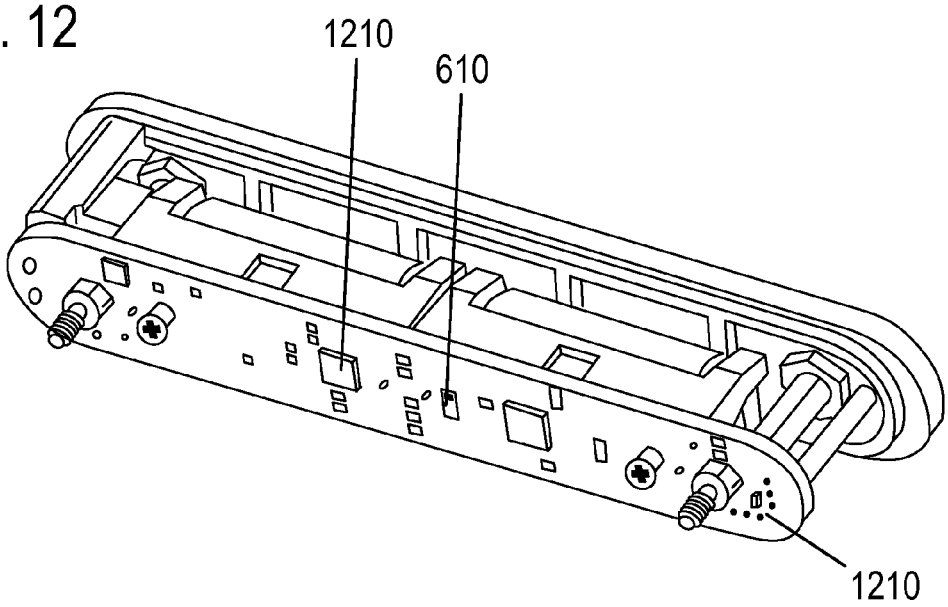

FIGS. 9-11 depict additional views of integrated electronic module 710. FIG. 9 depicts an example where batteries 910 and 912 are installed. FIG. 11 depicts the opening or aperture 612 in further detail. FIG. 12 further depicts various other electronic elements of circuit board 716, including e.g., an optical sensor/emitter 610 and a trigger actuation sensor 1210. Trigger actuation sensor 1210 may take the form of a Hall effect sensor, in at least some examples. These electronic elements may include any suitable electronic component or combination of operatively coupled electronic components, including microprocessors, mechanical sensors, optical sensors, electromagnetic radiation sources (e.g., LEDs, IR sources, etc.), audio speakers, etc. Microprocessors may be programmed with instructions that cause the microprocessors to receive input signal information via one or more input devices, and output command signal information to one or more output devices to provide any suitable functionality for the firearm training system.

Figure 13:
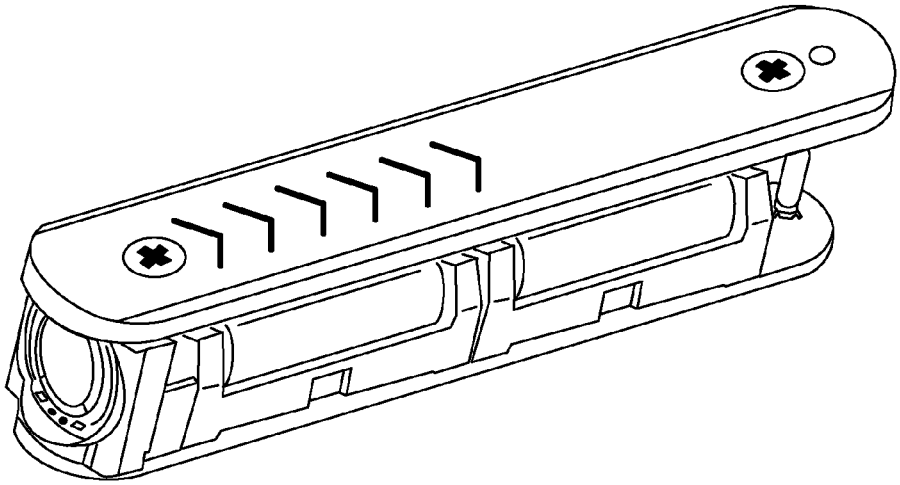
Figure 14:
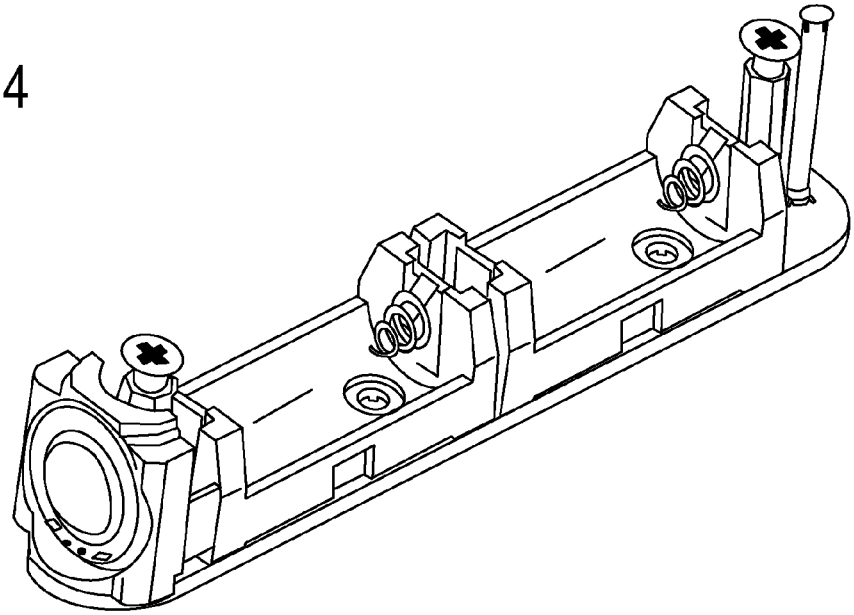

In at least one implementation, FIGS. 9, 10, and 11 depict an example of the integrated electronic module 710 in its entirety. Integrated electronic module 710 may be assembled with any suitable body form factor to provide a firearm training system that simulates or mimics any suitable commercially available firearm. Hence, integrated electronic module 710 may be utilized in a variety of different products spanning a diverse product line of firearm training systems. In one example, integrated electronic module 710 includes all of the input and/or output subsystems and provides all of the functions supported by the firearm training system, including trigger pull detection via the trigger assembly, audio output via audio speaker assembly 720, trigger region incursion detection via sensor subsystem 610, inputs and/or outputs supported by electronic element 1210, transmitting element 722, and interface element 512, power management from power supplied by one or more batteries, and/or other suitable inputs and/or outputs or functionality supported by the firearm training system. FIGS. 13 and 14 provide additional views of the integrated electronic module with and without the cover and batteries.

In at least some implementations, integrated electronic module 710 output signals indicative of detected trigger pull and detected incursion of an object into the trigger region, respectively. Integrated electronic module 710 receives signals output by one or more sensors, processes those signals, and provides an output responsive to those signals. Integrated electronic module 710 may receive electrical energy from one or more batteries. Integrated electronic module 710 may provide control signals and/or electrical energy to sensor subsystem 610, such as to control and/or power the infrared light source or other suitable light source.

In at least some implementations, the output of integrated electronic module 710 may include output signals directed to the audio speaker or other suitable audio output device. As one example, responsive to a trigger pull detected by via a trigger sensor mounted on circuit board 716, integrated electronic module 710 may generate an audio output via the audio speaker. As another example, responsive to an object entering within or near the trigger region as detected via sensor subsystem 610, the integrated electronic module may generate an audio output via the audio speaker. The audio output generated in response to a trigger pull may differ from or may be the same as the audio output generated in response to incursion of an object into or near the trigger region, depending on implementation.

In at least some implementations, the output of the integrated electronic module may include output signals directed at one or more light emitting elements. As one example, responsive to a trigger pull, a visible light output may be generated via one or more light emitting elements. As another example, responsive to an object entering within or near the trigger region a visible light output may be generated via one or more light emitting elements. The visible light output generated in response to a trigger pull may differ from or may be the same as the visible light output (e.g., color, flashing frequency, duration, etc.) generated in response to incursion of an object into or near the trigger region, depending on implementation, and may utilize the same or different light emitting elements.

Figure 15:
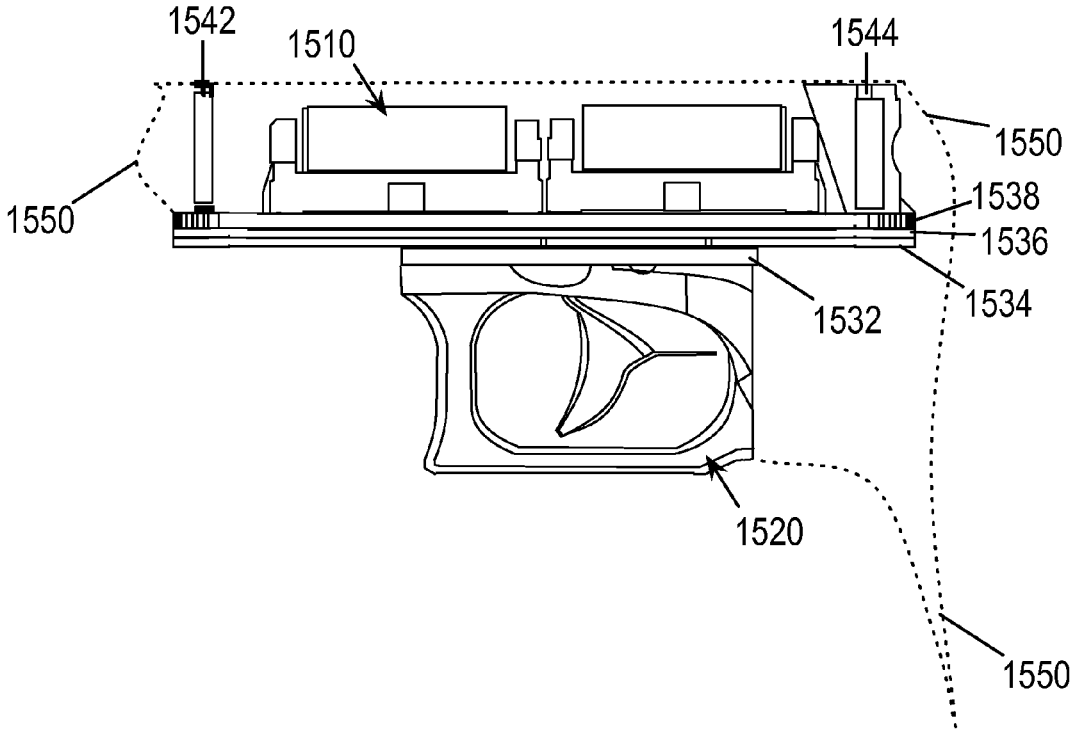
FIG. 15 depicts another embodiment of a firearm training system having a trigger guard that is separate from the device body.

FIG. 15 depicts another embodiment of a firearm training system 1500 having a trigger guard that is separate from the device body (i.e., formed from a separate material and combined with the device to form a simulated firearm). Firearm training system 1500 provides another non-limiting example of previously described firearm training system 100 of FIG. 1. It will also be appreciated that any of the subject matter previously described with reference to FIGS. 1-14 may be similar to or utilized in combination with the separate trigger guard approach of firearm training system 1500. For example, electronic module 1510 may take the form of previously described electronic module 710.

Firearm training system 1500 includes a device body 1550 simulating a first portion of a firearm. The first portion of the firearm may, for example, simulate at least a portion of a barrel and/or a handle of the firearm, among other suitable firearm components. For example, device body 1550 may take the form of a handgun or other suitable firearm form factor. Surfaces of the device body may have a first light absorbent property, such as a brightly colored surface, for example. Firearm training system 1500 includes a trigger guard 1520 simulating a second portion of the firearm. The trigger guard in this example includes one or more interior facing surfaces that at least partially define a trigger region containing a trigger.

Electronic module 1510 includes one or more optical sensors, such as previously described with respect to FIGS. 1-14. The optical sensors may, for example, observe the trigger region through an opening formed in an opposing interior facing surface of the trigger region (e.g., ceiling of the trigger region) that opposes the one or more interior facing surfaces of the trigger guard. The one or more interior facing surfaces of the trigger guard may have a light absorbent property that filters reflected light within a defined wavelength or wavelength range to a greater extent than the device body.

At least one advantage of the separate trigger guard from the device body includes the ability to utilize a different material having a greater light absorbent property for the trigger guard relative to a material of the device body. As a non-limiting example, the device body may be formed from injection molded plastic having a lower light absorbent property/higher light reflectivity (e.g., a brighter color) and the trigger guard may be formed from injection molded plastic having a higher light absorbent property/lower light reflectivity (e.g., a darker color). This approach may achieve the same or similar advantages as a trigger guard that is integrated with the device body of the firearm training system, but at a lower manufacturing cost or complexity due to the ability to utilize different materials as opposed to utilizing subsequently-applied surface treatments.

Firearm training system 1500 may further include a trigger assembly that includes a trigger located within the trigger region. The field of view of the one or more optical sensors may include one or more surfaces of the trigger. The one or more surfaces of the trigger may also have a light absorbent property that filters reflected light within the defined wavelength or wavelength range to a greater extent than the device body.

FIG. 15 further depicts various layers that may form the electronic module and trigger assembly, including a mounting element 1534 of the trigger assembly, a gasket 1536 located between mounting element 1532 and circuit board 1538. Mounting element 1534 may include a mounting plate or bracket, and may be formed from sheet metal or other suitable material. In at least some implementations, gasket 1536 may be omitted. A mounting surface 1532 of the trigger assembly, that includes the trigger guard 1520 and forms the ceiling of the trigger region, may interface with mounting element 1534.

One or more of mounting surface 1532, mounting element 1534, and gasket 1534, may include or define an opening through which one or more optical sensors observe the trigger region, such as previously described opening 612. These components may include additional openings, such as behind the trigger to provide a signal path between the trigger and a Hall effect sensor or other suitable sensor for detecting trigger actuation. Posts 1542 and 1544 may take the form of previously described posts 810 and 812 used to secure the trigger assembly, electronic module, and/or cover to the device body. However, in the embodiment of FIG. 15, the trigger guard may additionally be secured to the device body, trigger assembly, and/or electronic module by posts 1542 and 1544. Alternatively or additionally, other suitable fasteners may be used to secure the trigger guard to the device body, trigger assembly, and/or electronic module. For example, the trigger guard including mounting surface 1532 may be secured to the bottom of circuit board 1538 by one or more additional fasteners rather than using posts 1542 and 1544. As a non-limiting example, the circuit board may contain #4-40 threaded PEM™ nuts soldered to the underside of the board for receiving bolts or screws that pass through mounting surface 1532, mounting element 1534, and/or gasket 1536. However, in some implementations, the trigger guard and one or more device body portions may be secured to each other by a snap fit or press fit.

In at least some examples, a trigger guard assembly may be formed from a single injection molded or printed plastic (e.g., nylon) component (or other suitable material such as metal, wood, ceramic, polymer, etc.) that defines the trigger guard, circuit board mounting surface (e.g., mounting surface 1532 and mounting element 1534), and the trigger hinge arm to which the trigger is rotatably coupled. A channel or void may be molded into the device body that is adapted to receive the trigger guard assembly and electronic module such that the trigger guard assembly slides down into the channel as it is installed from the upper side of the device body. The channel or void may be covered by an access panel to conceal the electronic module.

It will be understood that the disclosed embodiments are illustrative and not restrictive. Variations to the disclosed embodiments that fall within the metes and bounds of the claims, now or later presented, or the equivalence of such metes and bounds are intended to be embraced by the claims.

The invention claimed is:

1. A firearm training system, comprising:

a device body simulating a firearm that includes a trigger guard having one or more interior facing surfaces that at least partially define a trigger region; and an electronic module including one or more optical sensors observing the trigger region through an opening formed in an opposing interior facing surface along a ceiling of the trigger region of the device body that opposes the one or more interior facing surfaces of the trigger guard, the electronic module tuned to detect incursion of an object within the trigger region based on a defined wavelength or wavelength range of visible or infrared light captured by the one or more optical sensors;

wherein the one or more optical sensors have a field of view that includes at least a portion of the one or more interior facing surfaces of the trigger guard, and the one or more interior facing surfaces of the trigger guard have a light absorbent property that includes textured surfaces formed in the material of the trigger guard that reduces light reflection or increases light absorption within the defined wavelength or wavelength range of visible or infrared light to filter reflected light within the defined wavelength or wavelength range of visible or infrared light to a greater extent than one or more other surfaces of the device body located outside the field of view of the one or more optical sensors.

2. The firearm training system of claim 1, further comprising:

a trigger assembly that includes a trigger located within the trigger region;

wherein the field of view of the one or more optical sensors includes one or more surfaces of the trigger; and wherein the one or more surfaces of the trigger have a light absorbent property that filters reflected light within the defined wavelength or wavelength range to a greater extent than the one or more other surfaces of the device body located outside the field of view of the one or more optical sensors.

3. The firearm training system of claim 1, wherein the opening includes one or more interior facing surfaces have a light absorbent property that filters reflected light within the defined wavelength or wavelength range to a greater extent than the one or more other surfaces of the device body located outside the field of view of the one or more optical sensors.

4. The firearm training system of claim 1, wherein the one or more interior facing surfaces of the trigger guard have a darker surface color or lower reflectivity than the one or more other surfaces of the device body.

5. The firearm training system of claim 1, wherein the one or more interior facing surfaces of the trigger guard include a thin-film coating that filters light within the defined wavelength or wavelength range.

6. The firearm training system of claim 1, wherein the one or more interior facing surfaces of the trigger guard include a matte finish that reduces light reflection or light absorption within the defined wavelength or wavelength range.

7. A firearm training system, comprising:

a device body simulating a first portion of a firearm, the device body formed from or includes surfaces having a first light absorbent property;

a trigger guard simulating a second portion of the firearm, the trigger guard having one or more interior facing surfaces that at least partially define a trigger region; and an electronic module including one or more optical sensors observing the trigger region through an opening formed in an opposing interior facing surface along a ceiling of the trigger region of the device body that opposes the one or more interior facing surfaces of the trigger guard, the electronic module tuned to detect incursion of an object within the trigger region based on a defined wavelength or wavelength range of visible or infrared light captured by the one or more optical sensors, the one or more optical sensors having a field of view that includes at least a portion of the one or more interior facing surfaces of the trigger guard;

wherein the one or more interior facing surfaces of the trigger guard have a light absorbent property that includes textured surfaces formed in the material of the trigger guard that reduces light reflection or increases light absorption within the defined wavelength or wavelength range of visible or infrared light to filter reflected light within the defined wavelength or wavelength range of visible or infrared light to a greater extent than the device body.

8. The firearm training system of claim 7, wherein the first portion of the firearm simulates at least a portion of a barrel, slide, and a handle of the firearm; and wherein the barrel, slide, and/or the handle include brightly colored surfaces.

9. The firearm training system of claim 7, further comprising:

a trigger assembly that includes a trigger located within the trigger region;

wherein the field of view of the one or more optical sensors includes one or more surfaces of the trigger; and wherein the one or more surfaces of the trigger have a light absorbent property that filters reflected light within the defined wavelength or wavelength range to a greater extent than the device body.

10. The firearm training system of claim 7, wherein the opening formed in the opposing interior facing surface includes one or more interior facing surfaces have a light absorbent property that filters reflected light within the defined wavelength or wavelength range to a greater extent than the device body.

11. The firearm training system of claim 7, wherein the trigger guard has a darker surface color or lesser reflectivity than the one or more other surfaces of the device body.

12. The firearm training system of claim 7, wherein the one or more interior facing surfaces of the trigger guard include a thin-film coating that filters light within the defined wavelength or wavelength range.

13. The firearm training system of claim 7, wherein the one or more interior facing surfaces of the trigger guard include a matte finish that reduces light reflection or light absorption within the defined wavelength or wavelength range.

* * * * *